US006175344B1

(12) United States Patent
Tanaka

(10) Patent No.: US 6,175,344 B1
(45) Date of Patent: Jan. 16, 2001

(54) FIELD EMISSION IMAGE DISPLAY AND METHOD OF DRIVING THE SAME

(75) Inventor: Mitsuru Tanaka, Mobara (JP)

(73) Assignee: Futaba Denshi Kogyo Kabushiki Kaisha, Mobara (JP)

( * ) Notice: Under 35 U.S.C. 154(b), the term of this patent shall be extended for 0 days.

(21) Appl. No.: 09/132,993

(22) Filed: Aug. 12, 1998

(30) Foreign Application Priority Data

Aug. 28, 1997 (JP) ..... 09-232959

(51) Int. Cl.[7] ..... G09G 3/22
(52) U.S. Cl. ..... 345/75.2
(58) Field of Search ..... 345/74, 75, 74.1, 345/75.1, 75.2, 76

(56) References Cited

U.S. PATENT DOCUMENTS

| | | | |
|---|---|---|---|
| Re. 32,856 | 2/1989 | Millsap et al. | 340/539 |
| 4,450,320 | 5/1984 | Ostermann et al. | 179/5 R |
| 4,465,904 | 8/1984 | Gottsegen et al. | 179/5 R |
| 4,511,886 | 4/1985 | Rodriguez | 340/534 |
| 4,825,457 | 4/1989 | Lebowitz | 379/40 |
| 4,868,859 | 9/1989 | Sheffer | 379/39 |
| 4,887,290 | 12/1989 | Dop et al. | 379/33 |
| 4,937,851 | 6/1990 | Lynch et al. | 379/32 |
| 4,993,059 | 2/1991 | Smith et al. | 379/39 |
| 5,125,021 | 6/1992 | Lebowitz | 379/40 |
| 5,128,979 | 7/1992 | Reich et al. | 379/40 |
| 5,134,644 | 7/1992 | Garton et al. | 379/39 |
| 5,146,486 | 9/1992 | Lebowitz | 379/40 |
| 5,233,640 | 8/1993 | Kostusiak | 379/39 |
| 5,249,223 | 9/1993 | Vanacore | 379/45 |
| 5,253,288 | 10/1993 | Frey et al. | 379/221 |
| 5,323,444 | 6/1994 | Ertz et al. | 379/212 |
| 5,327,478 | 7/1994 | Lebowitz | 379/40 |
| 5,388,145 | 2/1995 | Mulrow et al. | 379/45 |
| 5,404,350 | 4/1995 | DeVito et al. | 370/16 |
| 5,408,520 | 4/1995 | Clark et al. | 379/93 |
| 5,424,708 | 6/1995 | Ballesty et al. | 379/37 |
| 5,454,024 | 9/1995 | Lebowitz | 379/40 |
| 5,454,025 | 9/1995 | Mulrow et al. | 379/45 |
| 5,481,602 | 1/1996 | Griffiths et al. | 379/210 |
| 5,703,610 * | 12/1997 | Kishino et al. | 345/74 |
| 5,703,611 * | 12/1997 | Kishino et al. | 345/74 |
| 5,721,561 * | 2/1998 | Kishino et al. | 345/75 |
| 5,949,394 * | 9/1999 | Kishino et al. | 345/74 |

OTHER PUBLICATIONS

U.S. application No. 09/132,993, filed Aug. 12, 1998, pending.

U.S. application No. 09/501,238, filed Feb. 10, 2000, pending.

* cited by examiner

*Primary Examiner*—Richard A. Hjerpe
*Assistant Examiner*—Ronald Laneau
(74) *Attorney, Agent, or Firm*—Oblon, Spivak, McClelland, Maier & Neustadt, P.C.

(57) ABSTRACT

A field emission image display that can provide color blur-free, high brightness, high resolution images is provided. Patchlike cathode electrodes are connected in a zigzag pattern with cathode lead-out electrodes. Plural patchlike gate electrode pairs arranged in the row direction in two lines of patchlike gate electrodes adjacent to each gate lead-out electrode are connected to the gate lead-out electrode every other row. The right neighbor patchlike gate electrode and the left neighbor patchlike gate electrode with respect to the patchlike gate electrodes to be driven are set to a low potential. At the same time, the anode electrode area immediately above the driven patchlike gate electrode is driven. Anode electrodes neighbor to the driven anode electrode are set to a low potential.

1 Claim, 13 Drawing Sheets

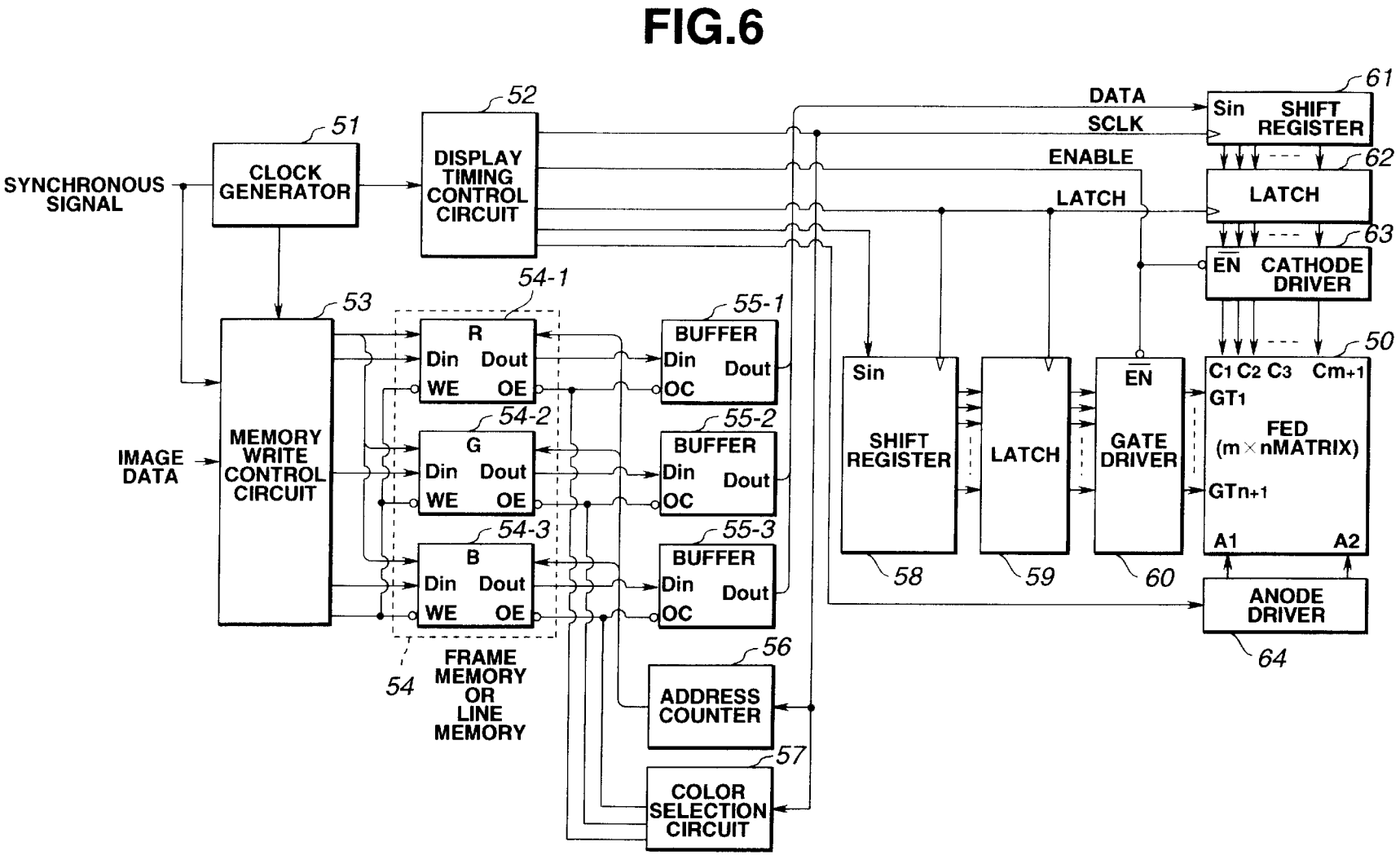
FIG.6
61
SHIFT REGISTER
Sin
62
LATCH
63
CATHODE DRIVER
EN
50
FED
(m×nMATRIX)
C1 C2 C3 Cm+1
GT1
GTn+1
A1
A2
ANODE DRIVER
64
DATA
SCLK
ENABLE
LATCH
EN
GATE DRIVER
60
LATCH
59
SHIFT REGISTER
Sin
58
55-1
BUFFER
Din Dout
OC
55-2
BUFFER
Din Dout
OC
55-3
BUFFER
Din Dout
OC
56
ADDRESS COUNTER
57
COLOR SELECTION CIRCUIT
52
DISPLAY TIMING CONTROL CIRCUIT
54-1
R
Din Dout
WE OE
54-2
G
Din Dout
WE OE
54-3
B
Din Dout
WE OE
FRAME MEMORY OR LINE MEMORY
54
51
CLOCK GENERATOR
53
MEMORY WRITE CONTROL CIRCUIT
SYNCHRONOUS SIGNAL
IMAGE DATA

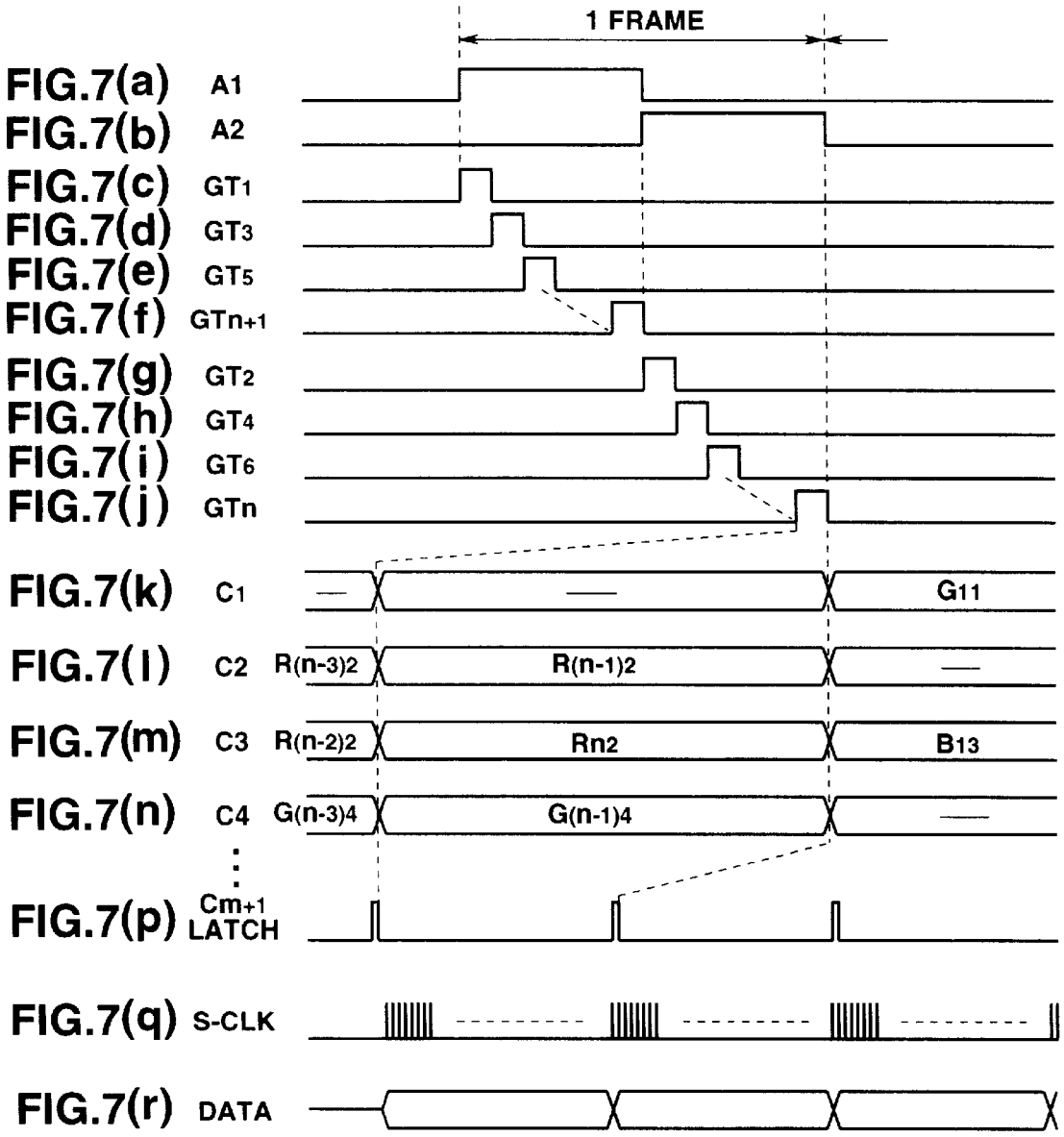
1 FRAME
FIG.7(a) A1
FIG.7(b) A2
FIG.7(c) GT1
FIG.7(d) GT3
FIG.7(e) GT5
FIG.7(f) GTn+1
FIG.7(g) GT2
FIG.7(h) GT4
FIG.7(i) GT6
FIG.7(j) GTn
FIG.7(k) C1
G11
FIG.7(l) C2
R(n-3)2
R(n-1)2
FIG.7(m) C3
R(n-2)2
Rn2
B13
FIG.7(n) C4
G(n-3)4
G(n-1)4
Cm+1
FIG.7(p) LATCH
FIG.7(q) S-CLK
FIG.7(r) DATA

FIELD EMISSION IMAGE DISPLAY AND METHOD OF DRIVING THE SAME

BACKGROUND OF THE INVENTION

1. Field of the Invention

The present invention relates to a field emission image display utilizing field emission and to a method of driving the same.

2. Description of the Related Art

When the electric field at a surface of a metal or semiconductor is as large as $10^9$ V/m, electrons pass through the potential barrier because of the tunnel effect, thus emitting out in a vacuum at room temperatures. This phenomenon is called field emission. The cathode which emits electrons on the principle is referred to as a field emission cathode.

Recently, flat emission type field emission cathodes each formed of an array of micron-size field emission type cathodes have been able to be manufactured fully using semiconductor processing technology.

The structure of a field emission cathode called a Spindt type cathode is schematically shown in FIGS. 13(*a*) and 13(*b*).

FIG. 13(*a*) is a perspective view showing a FEC fabricated using the semiconductor fine-patterning technology. FIG. 13(*b*) is a cross-sectional view illustrating the FEC taken along the line A—A shown in FIG. 13(*a*).

Referring to FIGS. 13(*a*) and 13(*b*), cathode electrodes 102 of aluminum are formed on a cathode substrate 101 of glass by using vapor deposition. Cone emitters 105 are formed on the cathode electrode 102. A great number of gate electrodes 104 are formed over the cathode electrode 102 where the cone emitter 105 are not formed, via the insulating layer 103 of silicon dioxide ($SiO_2$). The cone emitters 105 are respectively positioned in the openings formed in the gate electrode 104 and the insulating layer 103. That is, the tip of each cone emitter 105 is viewed in the opening formed in the gate electrode 104.

The pitch between the cone emitters 105 are fabricated to be less than 10 microns, using fine-patterning technology. Thus, several tens of thousands of FECs 105 to several hundreds of thousands of FECs 105 can be fabricated on a single substrate 101. The distance between the gate electrode 104 and the tip of the emitter 105 can be set in the order of submicrons. Hence the emitter 105 can emit electrons caused by the field emission by applying a small voltage of several ten volts between the gate electrode 104 and the cathode electrode 102.

The FEC can be made as a flat field emission cathode by forming an array of a great number of emitters 105 as shown in FIGS. 13(*a*) and 13(*b*). It has been proposed to apply the flat field emission cathode to flat color display panels. The cross-section of the color image display panel is partially shown in FIG. 14.

In FIG. 14, plural stripe cathode electrodes 102 are formed on the first substrate (cathode substrate) 101 of glass. Plural stripe gate electrodes 104 are arranged perpendicularly to the stripe-like cathode electrodes 102. The insulating layer 103 separates the cathode electrodes 102 from the gate electrodes 104. A great number of openings are respectively formed at the intersections where the cathode electrodes 102 and the gate electrodes 104 cross. The tip of each cone emitter 105 formed on the cathode electrode 102 within each opening directs upward.

The second substrate (anode substrate) 110 of glass is disposed so as to confront the first substrate 101. Metal anode electrodes 111 are formed nearly on the entire surface of the second substrate 110. Red fluorescent substance stripes 112 (R), green fluorescent substance stripes 113 (G), and blue fluorescent substance stripes 112 (B) are coated in one-to-one relationship at the corresponding positions of cathode electrodes 102 overlaying each anode electrode 111.

In the color image display with the above-mentioned structure, the stripe gate electrodes 104 are sequentially scanned one by one, and red, green and blue image data corresponding to one line selected with the gate electrode 104 are supplied to the stripe cathode electrodes 102. Thus, electrons of the amount corresponding to said image data are field-emitted from the emitter 105 disposed at the intersection of the gate electrode 104 and the cathode electrode 102 associated with the line in a driven state. The electrons impinge and glow the corresponding fluorescent substances 112 to 114. In such a manner, when all gates 104 are sequentially scanned and selectively driven, a full color image for one frame is displayed.

Generally, in the field emission image display, electrons emitted from the cone emitter 105 reach the anode electrode 111 with a beam angle of about 30. This means that electrons reach the anode electrode 111 with some divergence. This may cause electrons emitted from the emitter 105 to glow a adjacent different color fluorescent substances disposed on the anode substrate 111. Hence, there is the problem of blurring the displayed color image.

In order to solve such a problem, the present applicant proposed a field emission image display that can display blur-free color images by focusing electrons emitted from the emitter 105 (refer to Japanese Laid-open Patent publication (Tokkai-Hei) No. 8-298075).

FIG. 15 is a top view illustrating the field emission image display previously proposed.

Referring to FIG. 15, plural cathode electrodes 102 (depicted in chain lines) arranged on the first substrate are connected to cathode lead-out electrodes $C_1$, $C_2$, . . . , respectively.

Patchlike gate electrodes 120 corresponding to dots are arranged in two-dimensional matrix form on the cathode substrate 102 via an insulating layer (not shown). Two patchlike gate electrodes 120 are disposed on each cathode electrode 102 in the line direction perpendicular line direction. The emitters 105 (not shown) are arranged in an array pattern at the positions corresponding to the patchlike gate electrodes 120 on the cathode substrate 102.

The anode electrode 111 (shown in broken lines) is formed on the nearly entire surface of the second substrate (anode substrate) disposed corresponding to the cathode electrodes 102. R, G and B fluorescent substances are coated at the positions corresponding to the patchlike gate electrodes 120 on the anode electrode 111. In FIG. 15, symbols R, G and B labeled on each patchlike gate electrode 120 represent the luminous color of a fluorescent substance dot coated on the anode electrode 111.

As shown in FIG. 15, gate lead-out electrodes G are respectively connected to the patchlike gate electrodes arranged in the two-dimensional matrix. That is, the patchlike gate electrodes 120 corresponding to the odd-numbered G, B and R dots associated with the (i)-th line (column) are connected to the gate lead-out electrode $GT_{(i)-1}$. The patchlike gate electrodes 120 corresponding to the even-numbered R, G, and B dots associated with the (i)-th line are connected to the gate lead-out electrode $GT_{(i)-2}$.

The patchlike gate electrodes 120 corresponding to the odd-numbered G, B and R dots associated with the (i+1)-th line are connected to the gate lead-out electrode $GT_{(i+1)-1}$. The patchlike gate electrodes 120 corresponding to the even-numbered R, G and B dots associated with the (i+1)-th line are connected to the gate lead-out electrode $GT_{(i+1)-2}$. That is, two gate lead-out electrodes GT are alternately connected to patchlike gate electrodes 120 associated with each line.

A gate drive voltage is sequentially applied to the gate lead-out electrodes $GT_{(1)}$ to $GT_{(n)}$. When the gate lead-out electrode $GT_{(i)-2}$, for example, is driven, the even-numbered R, G and B dots (hatched) associated with the (i)-th line are driven. An image can be displayed when the cathode lead-out electrodes 102, 102, . . . corresponding to the patchlike gate electrodes 120 supply the corresponding image data in agreement with the scanning timing of the gate electrodes. In such a condition, by setting the gate lead-out electrodes $GT_{(i)-1}$, $GT_{(i+1)-1}$, $GT_{(i+1)-2}$ not driven at a low level, preferably to the ground potential, the neighbor patchlike gate electrodes 120 disposed around the patchlike gate electrode 120 (hatched) in a driven state are set to a low level potential. Thus, the electrons emitted from the patchlike gate electrode 120 in a driven state can reach the anode electrode in a focused beam state so that the blurred color can be eliminated.

In the field emission image display shown in FIG. 15, electrons emitted from the emitter 105 can reach a specific anode electrode with the beam focused so that the blurred color can be eliminated. Recently, there have been strong demands for image displays that can provide brighter, higher resolution images.

However, in the field emission image display shown in FIG. 15, the patchlike gate electrodes 120 are driven by means of two gate lead-out electrodes. Hence, the gate lead-out electrodes twice the number of actual display lines must be driven to display a full-color image for one frame by selectively driving all the display lines. For that reason, compared the case where the patchlike gate electrodes 120 associated with each line are driven by one gate lead-out electrode, the duty ratio becomes 1/2, so that it is difficult to realize a high brightness, high resolution image display.

SUMMARY OF THE INVENTION

The present invention is made to overcome the above-mentioned problems. The object of the invention is to provide a field emission image display that can realize a color blur-free, high brightness, high-resolution image.

The another object of the invention is to provide a field emission image display driving method that can realize a color blur-free, high brightness, high-resolution image.

According to the present invention, the field emission image display comprises a first substrate; plural patchlike cathode electrodes arranged in a matrix form on the first substrate, each of the patchlike cathode electrodes including emitters for field emission; cathode lead-out electrodes each being connected in a zigzag pattern to two neighbor rows of patchlike cathode electrodes in a two-dimensional matrix formed of the patchlike cathode electrodes; plural patchlike gate electrodes formed over the patchlike cathode electrodes; gate lead-out electrodes connected to plural patchlike gate electrode pairs arranged in the row direction every other row, the plural patchlike gate electrode pairs being associated with two neighbor lines in a two-dimensional matrix formed of the patchlike gate electrodes; a second substrate confronting the first substrate so as to be spaced from each other apart a predetermined distance; plural stripe anode electrodes arranged on the second substrate so as to confront the patchlike gate electrodes; fluorescent substance layers respectively coated on the anode electrodes; first anode lead-out electrodes connected to odd-numbered ones of the anode electrodes; and second anode lead-out electrodes for connected to even-numbered ones of the anode electrodes.

Furthermore, according to the present invention, the method of driving a field emission image display, the field emission image display including plural patchlike cathode electrodes arranged in a matrix pattern on a first substrate and having emitters for field emission, plural patchlike gate electrodes formed over the patchlike cathode electrodes, a second substrate spaced from the first substrate away a predetermined distance, and plural stripe gate electrodes arranged on the second substrate so as to confront the plural patchlike gate electrodes, the plural stripe gate electrodes each on which a fluorescent substance layer is coated, comprises the steps of driving a patchlike gate electrode on a gate voltage while gate electrodes adjacent to the patchlike gate electrode are driven on a gate voltage lower than the gate voltage; and simultaneously driving an anode electrode confronting the patchlike gate electrode in a driven state on an anode voltage while anode electrodes adjacent to the anode electrode in a driven state are driven on an anode voltage lower than the anode voltage.

According to the present invention, patchlike cathode electrodes are connected in a zigzag pattern to the cathode lead-out electrode. Plural patchlike gate electrode pairs arranged in the row direction in two lines of patchlike gate electrodes adjacent to each gate lead-out electrode are connected to the gate lead-out electrode every other row. Hence, the number of gate lead-out electrodes can be set to (n+1), only one greater than the number of display lines (n lines).

Moreover, patchlike gate electrodes arranged on both sides of each patchlike gate electrode driven are set to a low potential while anode electrode area immediately above the driven patchlike gate electrodes are simultaneously driven. Anode electrodes adjacent to the driven anode electrode are set to a low potential. This allows electrons from the emitter to be better focused.

The above and other objects, features and advantages of the present invention will become apparent from the following description when taken in conjunction with the accompanying drawings which illustrate preferred embodiments of the present invention by way of example.

BRIEF DESCRIPTION OF THE DRAWINGS

FIG. 6 is a block diagram illustrating a drive circuit for a field emission image display according to an embodiment of the present invention.

FIG. 7 is a timing chart illustrating timing sequences of drive signals for a field emission image display according to an embodiment of the present invention;

DETAILED DESCRIPTION OF THE PREFERRED EMBODIMENTS

Figure 1:
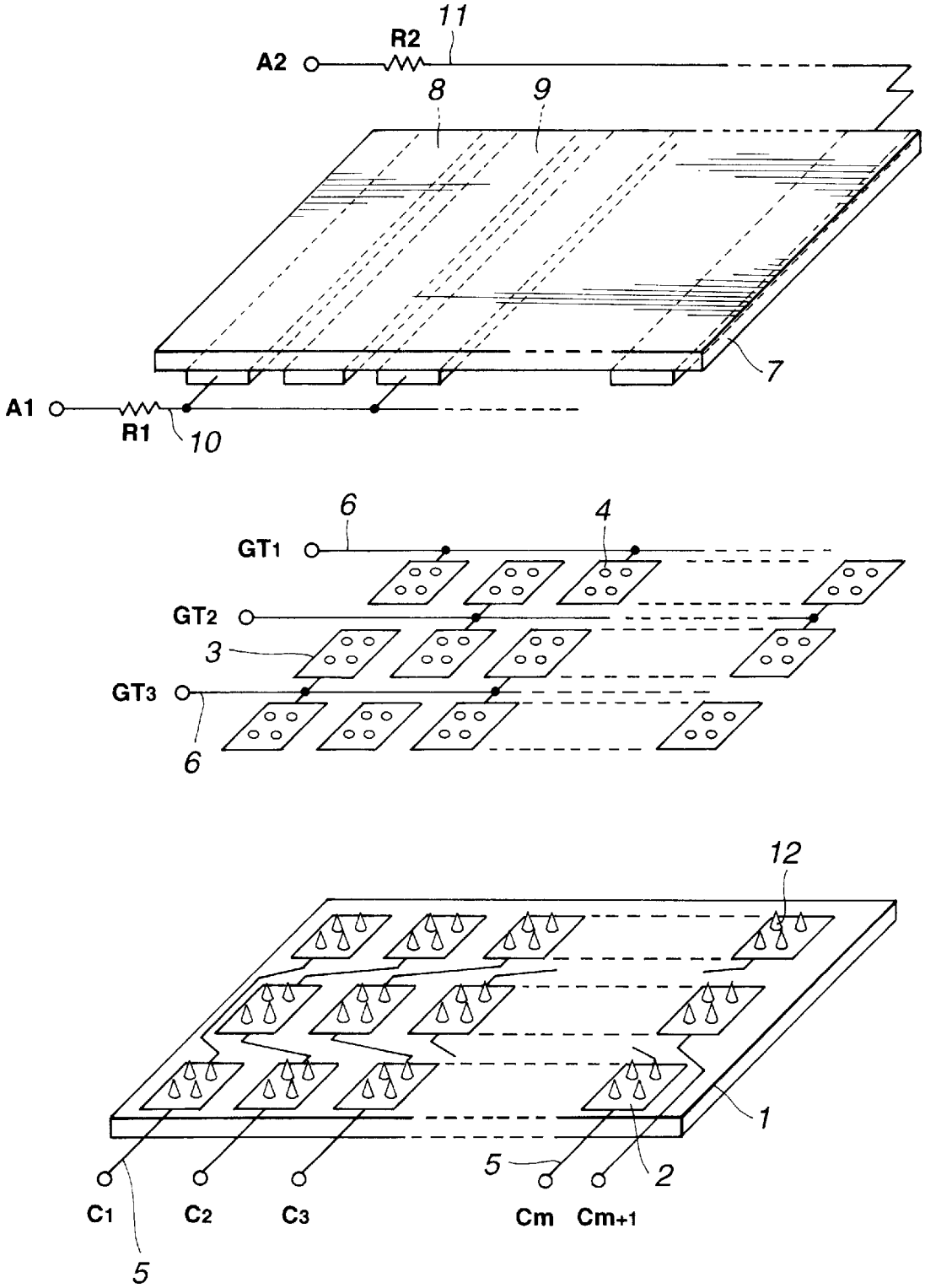
FIG. 1 is a perspective view illustrating a field emission image display according to an embodiment of the present invention.

FIG. 1 is a perspective view schematically illustrating the configuration of a field emission image display according to an embodiment of the present invention.

Referring to FIG. 1, a cathode substrate 1 is formed of a glass. Patchlike cathode electrodes are arranged in a matrix pattern on the cathode substrate 1. Each cathode electrode corresponds to one dot. Emitter arrays 12 are arranged on the patchlike cathode electrode 2. Patchlike gate electrodes 3 are formed over the patchlike cathode electrode 2 via an insulating layer. Openings 4 each through which electrons pass are formed in the patchlike gate electrode 4. Each opening 4 is formed so as to align with each emitter in an emitter array 12 formed over the patchlike electrode 2.

Cathode lead-out electrodes 5 ($C_1$ to $C_{m+1}$) are alternately connected to two neighbor rows of patchlike cathode electrodes 2 in a zigzag pattern, as shown in FIG. 1. Numeral 6 represents gate lead-out electrodes ($GT_1$, $GT_2$, $GT_3$, . . . ). Patchlike gate lead-out electrodes associated with the upper line and patchlike gate lead-out electrodes associated with the lower line are arranged in parallel to each gate lead-out line. Plural pairs of patchlike gate electrodes 3 arranged in the row direction perpendicular to the upper and lower lines (columns) are connected to each gate lead-out electrode 6 every other row.

Moreover, an anode substrate 7 is arranged so as to confront the cathode substrate 1. Stripe anode electrodes 8 and 9 are arranged on the anode substrate 7. The anode electrodes 8 and 9 are alternately arranged as shown in FIG. 1. A group of red (R), green (G) and blue (B) fluorescent substances (not shown) are sequentially coated on each of the anode electrodes 8.

Anode lead-out electrode 10 (A1) is connected to the anode electrodes 8 while anode lead-out electrode 11 (A2) is connected to the anode electrodes 9. A resistor R1 is inserted between the anode lead-out electrode A1 and the anode electrodes 8 to prevent electric discharge between anode and gate electrodes. A resistor R2 is inserted between the anode lead-out electrode A2 and the anode electrodes 9 to prevent electric discharge between anode and gate electrodes. In this case, lack of the resistors R1 and R2 does not affect the operation of the image display.

Figure 2:
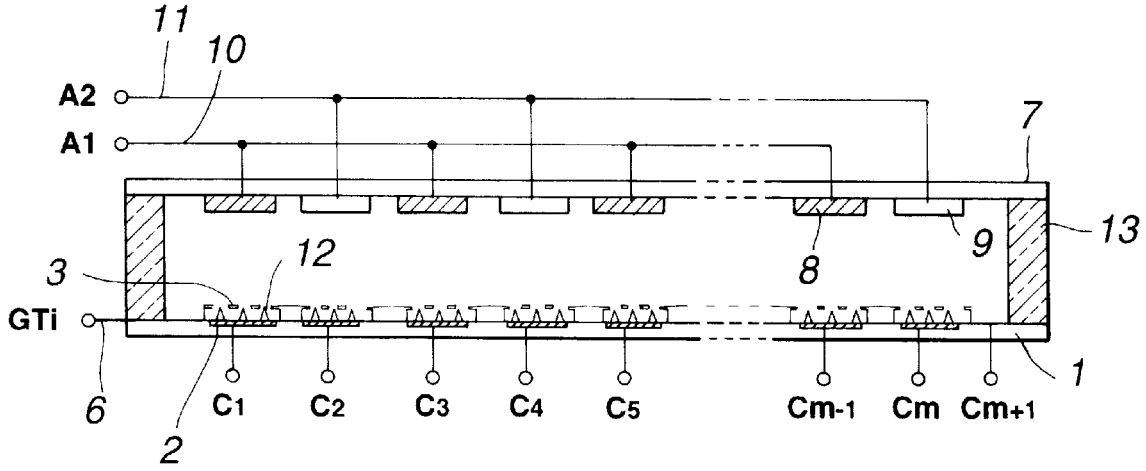
FIG. 2 a cross-sectional view illustrating a field emission image display according to an embodiment of the present invention.

FIG. 2 is a cross-sectional view illustrating the field emission image display shown in FIG. 1. The i-th gate lead-out electrode $GT_i$ (or 6) leads out of the patchlike gate electrode 3. Cone emitter arrays 12, each which field-emits electrons, are formed on the patchlike cathode electrode 2 using a semiconductor fine-engraving technique. Spacers 13 separates the cathode substrate 1 from the anode substrate 7 apart a predetermined distance. The container for an image display is formed of the cathode substrate 1, the anode substrate 7 and spacers 13. The inside of the container is maintained in high vacuum.

Figure 3:
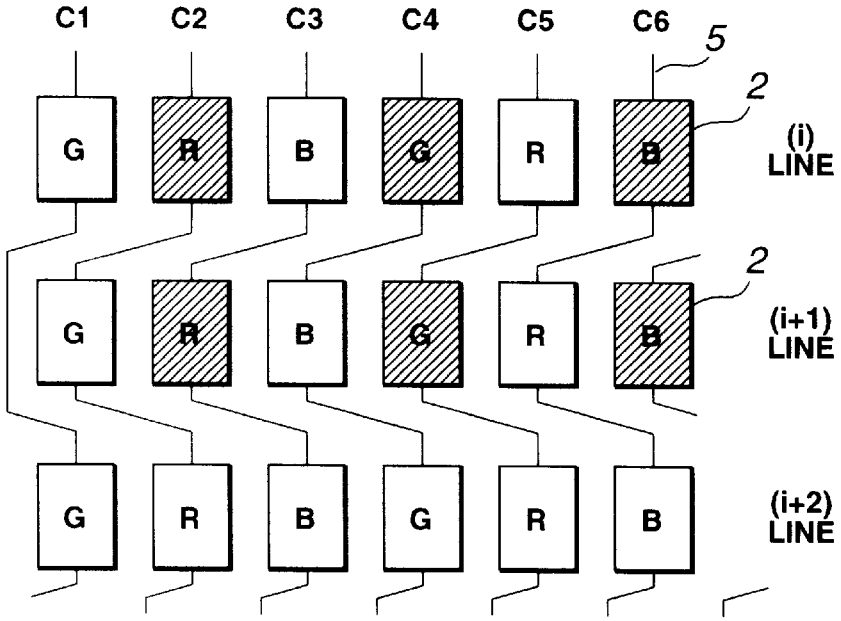
FIG. 3 is a diagram explaining the relationship between patchlike cathode electrodes and cathode lead-out electrodes in a field emission image display according to an embodiment of the present invention.
Figure 4:
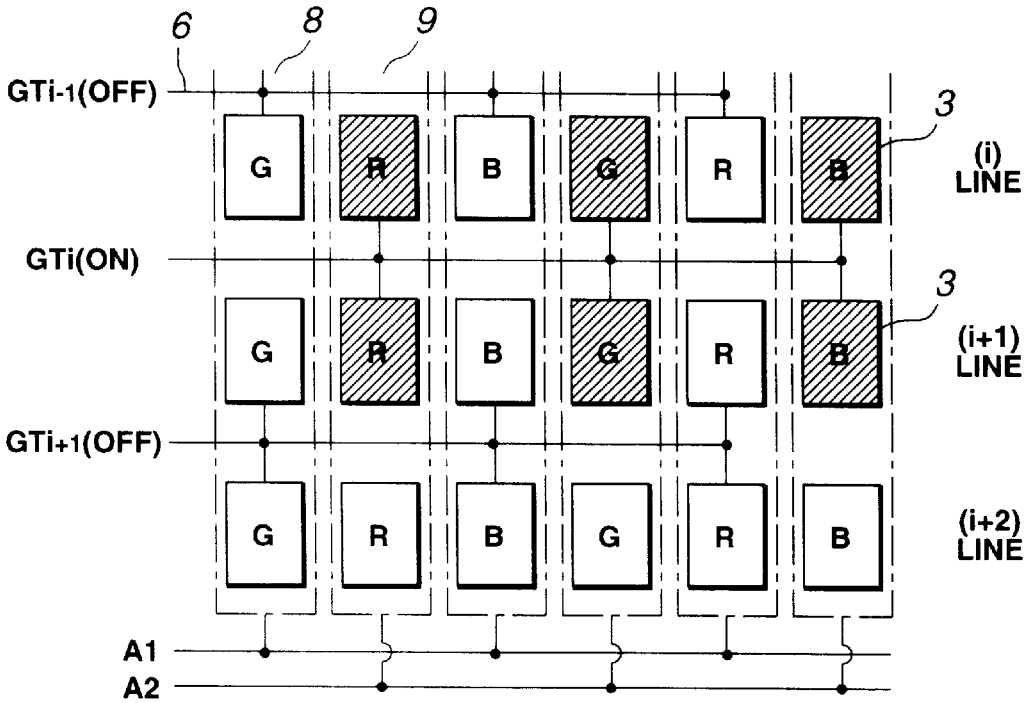
FIG. 4 is a diagram explaining the relationship between patchlike gate electrodes and gate lead-out electrodes in a field emission image display according to an embodiment of the present invention.

FIG. 3 is the plan view illustrating the patchlike cathode electrodes 2 formed on the cathode substrate 1. FIG. 4 is a plan view illustrating the relationship between the patchlike gate electrodes 3 and anode electrodes 8 and 9. Explanation will be made as to the relationship between the patchlike cathode electrode 2 and the cathode lead-out electrode 5 with reference to FIG. 3 as well as the relationship between the anode electrodes 8 and 9 and the anode lead-out electrodes 10 and 11 with reference to FIG. 4.

As shown in FIG. 3, each patchlike cathode electrode 2 corresponds to one dot. Each of patchlike cathode electrodes 2 associated with the i-th line (or the i-th column) is connected to the neighbor patchlike cathode electrode 2 associated with the (i+1)-th line and left-shifted by one in the row direction, with the cathode lead-out electrode 5. Each of patchlike cathode electrodes 2 associated with the (i+1)-th line is connected to the patchlike cathode electrode 2 associated with the (i+2)-th line and right-shifted in the row direction by one, with the cathode lead-out electrode 5. That is, patchlike cathode electrodes are connected in a zigzag pattern with the cathode lead-out electrode 5.

The cathode lead-out electrode 5 connected to the patchlike cathode electrode 2 on the leftmost row associated with the (i)-th line is connected to the patchlike cathode electrode on the leftmost row associated with the (i+2)-th line, instead of the patchlike cathode electrode 2 on the (i+1)-th line.

The embodiment where patchlike cathode electrodes 2 are connected with cathode lead-out electrode 5 in a zigzag pattern has been described by referring to FIG. 3. However, the patchlike cathode electrodes 2 may be connected to the cathode lead-out electrode 5 in various patterns. For example, the patchlike cathode electrodes 2 are connected to the cathode lead-out electrode 5 in a zigzag pattern.

Moreover, each cathode lead-out electrode 5 may be disposed between patchlike cathode electrodes 2 associated with each row. Thus, the patchlike cathode electrodes 2 are connected in a zigzag pattern to the cathode lead-out electrodes 5 arranged in the row direction, thus being lead out.

As shown in FIG. 4, patchlike gate electrodes 3 are formed over the patchlike cathode electrodes 2 through an insulating layer (not shown). Each patchlike gate electrode 3 corresponds to one dot. The odd-numbered patchlike gate electrodes corresponding to G, B and R dots associated with the (i)-th line (the i-th line) are connected to the gate lead-out electrode $GT_{i-1}$.

The remaining even-numbered patchlike gate electrodes 3 corresponding to R, G and B dots associated with the (i)-th line are connected to the gate lead-out electrodes $GT_i$. The even-numbered patchlike gate electrodes 3 corresponding to R, G and B dots associated with the (i+1)-th line are connected to the gate lead-out electrode $GT_i$.

The odd-numbered patchlike gate electrodes 3 corresponding to G, B and R dots associated with the (i+1)-th line and the patchlike gate electrodes 3 corresponding to G, B and R dots associated with the (i+2)-th line are connected to the gate lead-out electrode $GT_{i+1}$. That is, each gate lead-out line is connected to plural pairs of patchlike gate electrodes arranged in the row direction every other row among the patchlike gate electrodes 3 associated with the upper and the lower lines.

The stripe anode electrode 8 (shown with chain lines) is connected to the anode lead-out electrode A1 while the stripe anode electrode 9 (shown with chain lines) is connected to the anode lead-out electrode A2.

As described above, in the field emission display according to the present invention, the gate electrodes as well as the cathode electrodes are formed in a patchlike pattern. Patchlike cathode electrodes 2 arranged in two neighbor rows are connected to the cathode lead-out electrode 5 in a zigzag pattern. Plural pairs of patchlike gate electrodes 3 in the row direction in patchlike gate electrodes associated with two neighbor lines (columns) are connected to the gate lead-out electrode 6 every other row.

In the field emission display configured as shown above, with a gate drive voltage applied to the gate lead-out electrode $GT_i$ and an anode voltage applied to the anode lead-out electrode A2, the even-numbered R, G and B dots (hatched) associated with the (i)-th line and the (i+1) line shown in FIGS. 3 and 4 are driven. Image data corresponding to the patchlike gate electrodes 3 to be driven are supplied from the corresponding cathode electrodes $C_2$, $C_3$, . . . so that the fluorescent substance coated on the anode electrode 9 glows according to image data.

In this case, by setting the gate lead-out electrodes $GT_{i-1}$ and $GT_{i+1}$ not driven to the ground potential, the neighbor patchlike gate electrodes 3 around the patchlike gate electrode 3 in a driven state (hatched in FIG. 4) are set to the ground potential. By setting the anode lead-out electrode A1 not driven to the ground potential, the neighbor anode electrodes 8 around the anode electrode 9 not driven are set to the ground potential.

In such conditions, since the neighbor patchlike gate electrodes 3 around the patchlike gate electrode 3 in a driven state as well as the neighbor anode electrode 8, on which different color fluorescent substances are coated, around the anode electrode 9 in a driven state are set to a low voltage, electrons emitted from the emitter array 12 in a driven state are focused on the anode electrode 8 so that only the color fluorescent substance of interest can be glowed.

Where a negative potential is applied to the odd-numbered gate lead-out electrodes $GT_{i-1}$, $GT_{i+1}$ not driven and the anode lead-out electrode A1 to which an anode voltage is not applied, electrons emitted from the emitter array 12 on the cathode substrate 1 can be more focused.

The anode electrodes 8 and 9 and anode lead-out electrodes A1 and A2 formed on the anode substrate 7 generally requiring transparent characteristics are fabricated by patterning an ITO (Indium Tin Oxide) thin film. On the other hand, the patchlike cathode electrodes 2 and cathode lead-out electrodes 5 which do not require transparent characteristics are formed of a metal material.

The ITO thin film is more resistant to fine-patterning than metal materials. Hence, the cathode lead-out electrode 5 can be easily formed by connecting patchlike cathode electrodes of the present embodiment in a zigzag pattern, compared with forming the anode lead-out electrode by connecting patchlike anode electrodes in a zigzag pattern.

The method of driving the field emission image display of the present invention will be explained below by referring to FIGS. 5 to 9.

Figure 5:
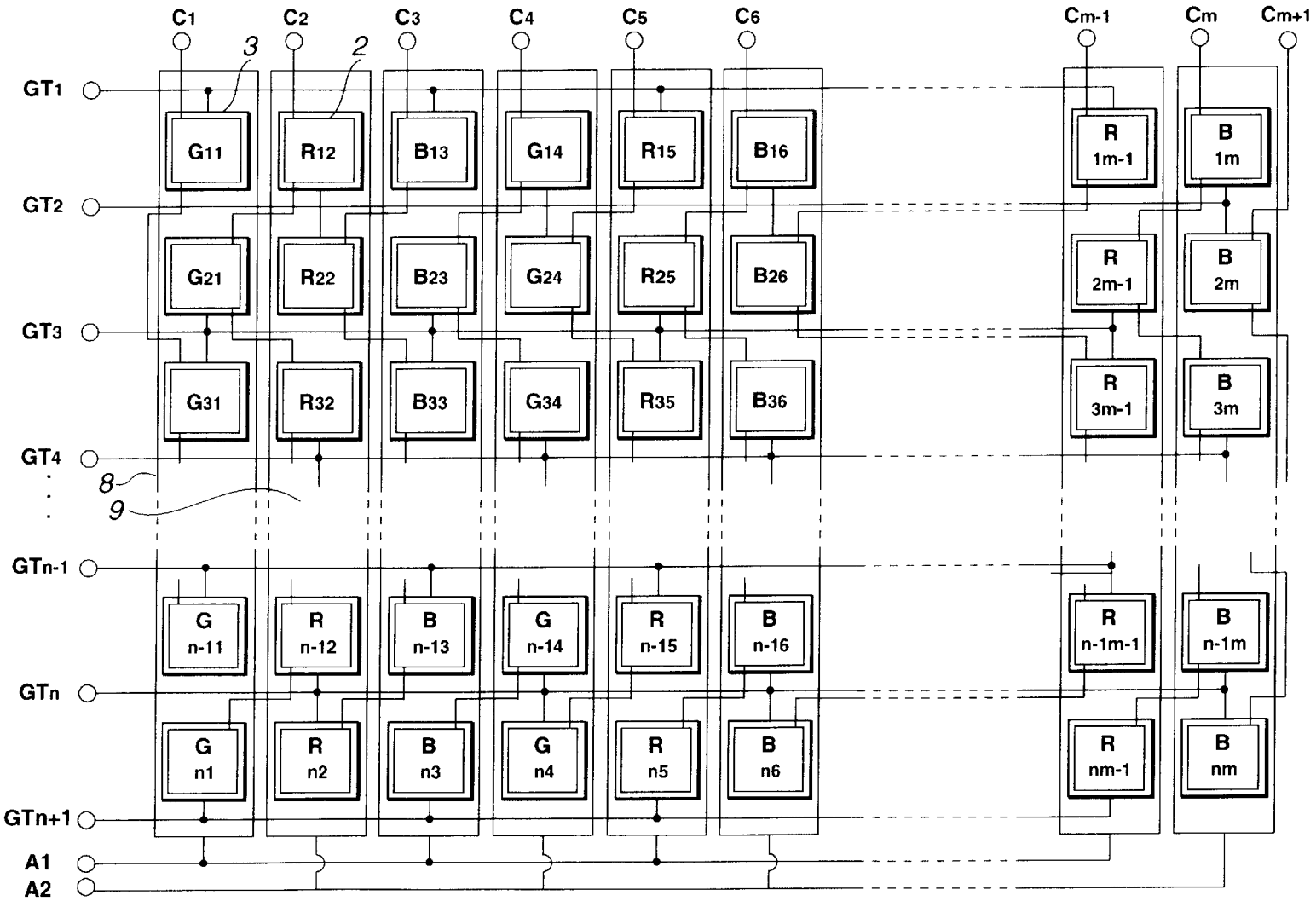
FIG. 5 is a diagram illustrating the arrangement of electrodes in a field emission image display according to an embodiment of the present invention.
Figure 8A:
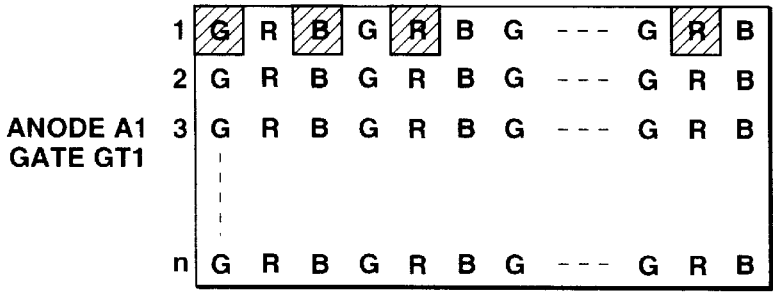
FIG. 8 is a diagram illustrating the dot selection operation in a field emission image display according to the present invention.
Figure 8B:
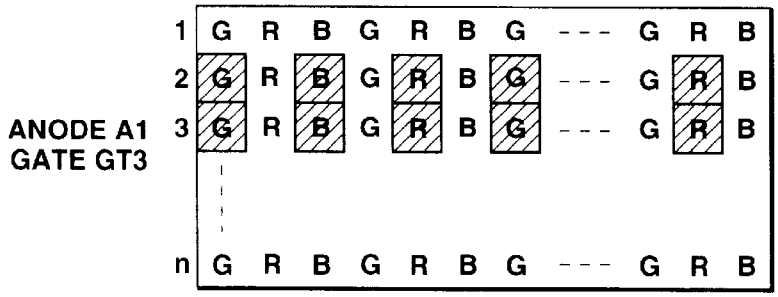
Figure 8C:
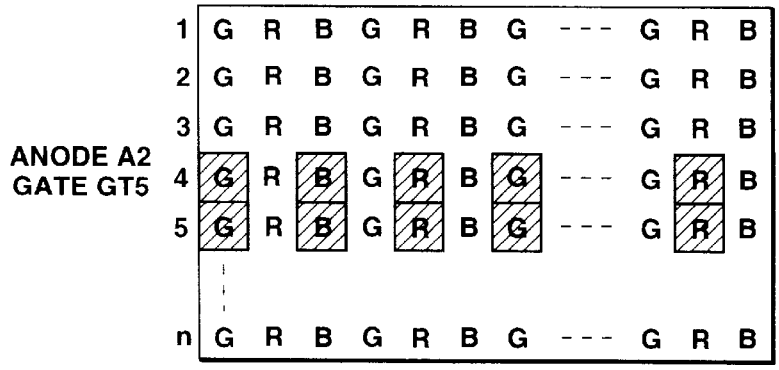
Figure 8D:
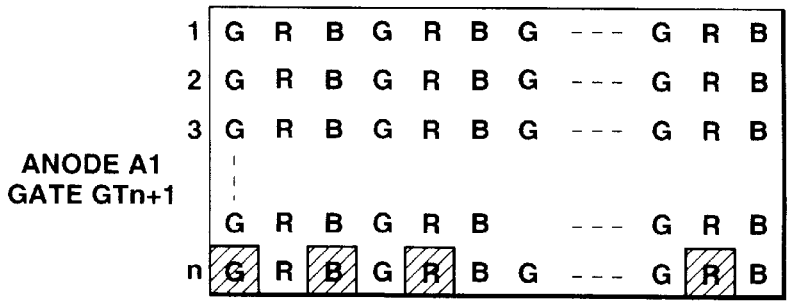

FIG. 5 shows the layout of respective electrodes viewed from the anode electrode side of the field emission image display of the present invention. FIG. 5 shows a field emission image display that displays a color image in an n×m matrix (where n is an even number).

In this case, patchlike cathode electrodes 2 arranged in a matrix form are arranged on the cathode substrate 1 (not shown). The patchlike cathode electrode 2 are connected to the cathode lead-out electrodes $C_1$ to $C_{m+1}$, in a zigzag pattern.

That is, the cathode lead-out electrode $C_2$ is connected to the second patchlike cathode electrode 2 rightward on the odd-numbered line and the leftmost patchlike cathode electrode 2 on the even-numbered line. Similarly, the patchlike cathode electrodes 2 associated with the right and left rows are connected to the gate lead-out electrodes $C_3$ to $C_m$ in a zigzag pattern. The cathode lead-out electrode $C_1$ is connected to only the leftmost patchlike cathode electrode 2 on the odd-numbered line. The last cathode lead-out electrode $C_{m+1}$ is connected to the m-th patchlike cathode electrode 2 rightward on the even numbered line. An emitter array 12 (not shown) is formed on each of the patchlike cathode electrodes 2.

The patchlike gate electrodes 3 are respectively isolated on the patchlike cathode electrodes 2. As already described, plural pairs of patchlike gate electrodes 3 in the row direction on patchlike gate electrodes associated with the upper and lower lines are connected to each of the lead-out electrodes $GT_1$ to $GT_{n+1}$ every other row.

That is, the gate lead-out electrode $GT_2$ is connected to the even-numbered patchlike gate electrodes 3 associated with the first and the second lines. The gate lead-out electrode $GT_3$ is connected to the odd-numbered patchlike gate electrodes 3 associated with the second and the third lines. Similarly, the even-numbered patchlike gate electrodes 3 associated with the upper and the lower lines are connected to the even-numbered gate lead-out electrodes $GT_4$, $GT_6$, . . . $GT_n$. The odd-numbered patchlike gate electrodes 3 associated with the upper and the lower lines (columns) are connected to the odd-numbered gate lead-out electrodes $GT_5$, $GT_7$, . . . $GT_{n-1}$. The gate lead-out electrode $GT_1$ is connected to only the odd-numbered patchlike gate electrode 3 associated with the first line. The last gate lead-out electrode $GT_{n+1}$ is connected to only the odd-numbered patchlike gate electrode 3 associated with the n-th line. Openings (not shown), through which electrons emitted from an emitter array pass, are formed in the patchlike gate electrode 3.

Furthermore, the patchlike gate electrodes 3 are spaced from the anode substrate 7 (not shown) apart a predetermined distance. Stripe anodes 8 and 9 are alternately arranged on the anode substrate 7 and in the row direction perpendicular to the gate lead-out electrodes $GT_1$ to $GT_{n+1}$. The anode electrodes 8 are connected to the anode lead-out electrode A1 while the anode electrodes 9 are connected to the anode lead-out electrode A2.

The G fluorescent substance, the R fluorescent substance, and the B fluorescent substance are sequentially coated from left to right on the anode electrodes 8 and 9 and act as dots. The first row is formed of dots $G_{11}$, $R_{12}$, $B_{13}$, $G_{14}$, $R_{15}$, $B_{16}$, . . . $R_{1(m-1)}$, and $B_{1m}$. The next row is formed of dots $G_{21}$, $R_{22}$, $B_{23}$, . . . $R_{2(m-1)}$ and $B_{2m}$. Similarly, the last row is formed of dots $Gn_1$, $Rn_2$, $Bn_3$, . . . $R_{n(m-1)}$, and $B_{nm}$.

Dots $G_{11}$ to $B_{nm}$ formed in a matrix form on the anode electrode 8 are sequentially scanned and selectively driven while dots $G_{11}$ to $B_{nm}$ formed in a matrix form on the anode electrode 9 are sequentially scanned and selectively driven, so that a desired image can be displayed.

Figure 9A:
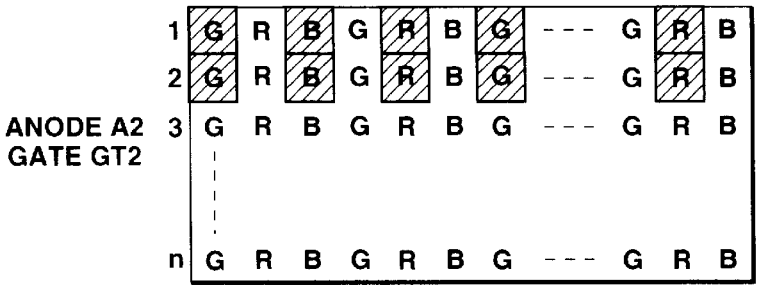
FIG. 9 is a diagram illustrating the dot selection operation in a field emission image display according to the present invention.
Figure 9B:
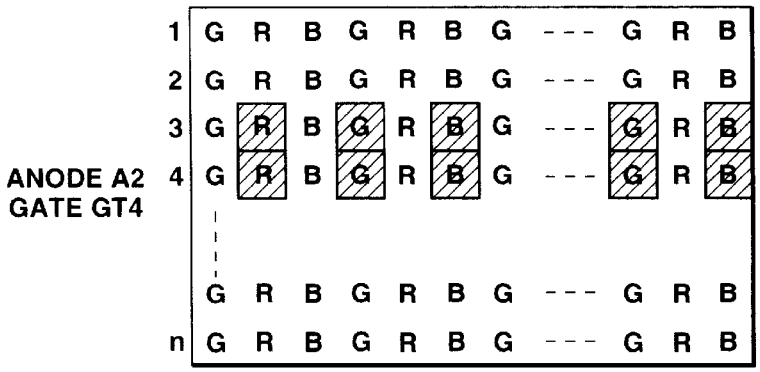
Figure 9C:
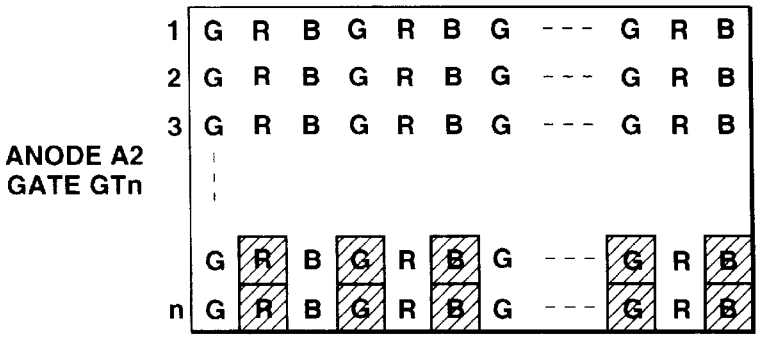

FIG. 6 is a block diagram illustrating an example of the driver circuit for driving the field emission image display. FIG. 7 shows the timing sequences of the driver circuit. FIGS. 8 and 9 show patterns of luminous dots. The driving method will be described below by referring to figures.

FIG. 6 is a diagram illustrating an example of the driver circuit. Referring to FIG. 6, numeral 50 represents a field emission image display formed of field emission cathodes in a m×n dot matrix as shown in FIG. 5; 51 represents a clock generator for generating clock pulses in synchronism with a synchronous signal; 52 represents a display timing control circuit for controlling the display timing using clock pulses from the clock generator 51; 53 represents a memory write control circuit for controlling the writing of input image data to a video memory 54; 54 represents a video memory formed of a frame memory for storing R, G and B image data or line memories 54-1, 54-2 and 54-3; and 55-1, 55-2 and 55-3 represent buffer memories each for holding R, G, and B image data read out of the video memory 54.

Moreover, numeral 56 represents an address counter for generating the address of the video memory 54; 57 represents a color selection circuit for selecting any one of R image data, G image data, and B image data; 59 represents a latch circuit for latching data of the shift register 58; 60 represents a gate driver for driving gate electrodes according to data from the latch circuit 59; 61 represents a shift register for shifting image data supplied from the buffer registers 55-1 to 55-3 with shift clock pulses; 62 represents a latch circuit for latching data from the shift register 61; 63 represents a cathode driver for supplying image data from the latch circuit 62 to the cathode electrode; and 64 represents an anode driver for driving anode lead-out electrodes A1 and A2.

FIG. 7 is a timing chart for explaining the relationships between timing sequences of various drive signals. FIG. 7(*a*) shows an output pulse from the anode driver 64 for driving the anode lead-out electrode A1. FIG. 7(*b*) shows an output pulse from the anode driver 64 for driving the anode lead-out electrode A2. FIG. 7(*c*) shows an output pulse from the gate driver 60 for driving the gate lead-out electrode $GT_1$. FIG. 7(*d*) shows an output pulse from the gate driver 60 for driving the gate lead-out electrode $GT_3$. FIG. 7(*e*) shows an output pulse from the gate driver 60 for driving the gate lead-out electrode $GT_5$. FIG. 7(*f*) shows an output pulse from the anode driver 60 for driving the gate lead-out electrode $GT_{n+1}$. FIG. 7(*g*) shows an output pulse from the gate driver 60 for driving the gate lead-out electrode $GT_2$ when the second anode electrode A2 is activated after completion of the ½ frame scanning; FIG. 7(*h*) shows an output pulse from the gate driver 60 for driving the gate lead-out electrode $GT_4$; FIG. 7(*i*) shows an output pulse from the gate driver 60 for driving the gate lead-out electrode $GT_6$; and FIG. 7(*j*) shows an output pulse from the gate driver 60 for driving the gate lead-out electrode $GT_n$.

Moreover, FIG. 7(*k*) shows image data from the cathode driver 63 applied to the cathode lead-out electrode $C_1$; FIG. 7(*l*) shows image data from the cathode driver 63 applied to the cathode lead-out electrode $C_2$; FIG. 7(*m*) shows image data from the cathode driver 63 applied to the cathode lead-out electrode $C_3$; FIG. 7(*n*) shows image data from the cathode driver 63 applied to the cathode lead-out electrode $C_4$; FIG. 7(*p*) shows a latch pulse representing the latch timing of the latch circuit 59 and a latch pulse representing the latch timing of the latch circuit 62; FIG. 7(*q*) shows a shift clock supplied to the shift register 61; and FIG. 7(*r*) shows image data in a display order supplied from the buffer registers 55-1, 55-2 and 55-3 to the shift register 61.

Next, the operation of the drive circuit shown in FIG. 6 will be described below with reference to the timing chart shown in FIG. 7.

The memory write control circuit 53 controls the write timing of image data. The video memory 54 stores image data for each color in synchronism with clock pulses from the clock generator 51. In the video memory 54, the memory 54-1 stores R image data; the memory 54-2 stores G image data; and the memory 54-3 stores B image data. The buffer register 55-1 holds image data read out of the memory 54-1 under control of the color selection circuit 57 and based on the address of the address counter 56. The buffer register 55-2 holds image data read out of the memory 54-2 under control of the color selection circuit 57 and based on the address of the address counter 56. The buffer register 55-3 holds image data read out of the memory 54-3 under control of the color selection circuit 57 and based on the address of the address counter 56.

The color selection circuit 57 controls the output timing of each of the buffer registers 55-1, 55-2 and 55-3. The image data are supplied in the display order of R, G and B dots (shown in FIG. 8) to the shift register circuit 61. The shift register 61 shifts the image data according to the shift clock S-CLK shown in FIG. 7(*q*).

When the shift register 61 shifts R, G and B image data for two lines, the image data corresponding to ½ of the patchlike gate electrodes 3 associated with one line, the latch circuit 62 latches the color data by means of the latch pulse shown in FIG. 7(*p*). The output data from the latch circuit 62 is supplied to the cathode driver 63.

The display timing control circuit 52 controls the anode driver 64 and then applies a positive anode voltage only to the anode lead-out electrode A1, as shown in FIGS. 7(*a*) and 7(*b*).

The display timing control circuit 52 also supplies as a shift pulse the latch pulse (shown in FIG. 7(*p*)) to the shift register 58 and then shifts the scan signal supplied therefrom. The latch circuit 59 latches the output signals from the shift register 58 every other signal, according to the latch pulse. Thus, the latch circuit 59 outputs a scan signal shifted every other latch pulse. The scan signal is applied to the gate driver 60.

As a result, the gate driver 60 sequentially outputs a gate drive voltage to the gate lead-out electrodes $GT_1$, $GT_3$, $GT_5$, . . . $GT_{n+1}$ (arranged every other gate as shown in FIGS. 7(*c*), 7(*d*), 7(*e*) and 7(*f*)) among the gate lead-out electrodes $GT_1$ to $GT_{n+1}$ of the image display 50. The gate lead-out electrodes $GT_1$, $GT_3$, $GT_5$, . . . $GT_{n+1}$ are scanned with the timing of the latch pulse.

At this time, the cathode driver circuit 63 supplies image data for two lines to the cathode lead-out electrodes $C_1$, $C_2$, $C_3$, . . . $C_{m+1}$ every other electrode, in synchronism with the scanning operation of the gate lead-out electrodes $GT_1$, $GT_3$, $GT_5$, . . . $GT_{n+1}$.

FIGS. 8 and 9 are diagrams each explaining the case where each dot is glowed in the field emission image display. When the gate lead-out electrode $GT_1$ is selectively driven, the even-numbered dots $G_{11}$, $B_{13}$, . . . associated with the first line are controllably glowed as shown in FIG. 8(*a*). In this case, the even-numbered dots $R_{12}$, $G_{14}$, $B_{16}$, . . . not driven are set to the ground potential (or a negative potential).

Hence, half of dots associated with the first line in the image display 50 are glowed as shown in FIG. 8(*a*). The gate electrode 3 focuses the emitted electrons onto the anode electrode 8 because the adjacent patchlike gate electrodes 3 are set to the ground level (or a negative potential).

At this time, since a positive anode voltage is applied to the anode lead-out electrode A1 and the ground level (or a negative potential) is applied to the anode lead-out electrode A2, anode electrodes 9 adjacent to the anode electrode 8 becomes the ground level (or a negative voltage). As a result, the emitted electrons are more focused onto the anode electrode 8. In this case, even when the emitted electrons reach adjacent anode electrodes 9, the ground potential (or negative potential) applied to the anode electrode 9 enables leakage of light emission to be prevented.

When the gate lead-out electrode $GT_3$ is selectively driven with the next latch pulse timing, the shift register 61 shifts the odd-numbered image data associated with the second and the third lines by the shift clock S-CLK. Thus, in the image display 50, dots corresponding to ½ of dots associated with the second line and dots corresponding to ½ of dots associated with the third line can be controllably glowed as shown in FIG. 8(*b*).

Similarly, when the gate lead-out electrode $GT_5$ is selectively driven with the next latch pulse timing, the shift register 61 shifts the odd-numbered image data associated with the fourth and the fifth lines by the shift clock S-CLK. Thus, in the image display 50, dots corresponding to ½ of dots associated with the fourth line and dots corresponding to ½ of dots associated with the fifth line can be controllably glowed as shown in FIG. 8(*c*).

In such scanning sequences, when the gate lead-out electrode $GT_{n+1}$ is selectively driven, the shift register 61 shifts the odd-numbered image data associated with the n-th line by the shift clock S-CLK. In the image display 50, dots corresponding to ½ of dots associated with the second line and dots corresponding to ½ of dots associated with the n-th line can be controllably glowed as shown in FIG. 8(*d*). Thus, ½ of dots corresponding to one frame are controllably glowed.

When the gate lead-out electrode $GT_{n+1}$ is scanned, the display control timing circuit 52 controls the anode driver 64. Thus, a positive anode voltage is applied to the anode lead-out electrode A2, instead of the anode lead-out electrode A1, as shown in FIGS. 7(*a*) and 7(*b*). The scan signal supplied from the control circuit 52 is shifted by supplying the latch pulse shown in FIG. 7(*p*) as a shift pulse to the shift register 58. The latch circuit 59 latches the output signals from the shift register 58 every other latch pulse. The latch circuit 59 outputs the scan signal shifted every other latch pulse to the gate driver 60.

In this case, the gate driver 60 outputs the gate drive voltages to the gate lead-out electrodes $GT_2$, $GT_4$, $GT_6$, . . . GTn arranged every other electrode in the image display 50, as shown in FIGS. 7(*g*), 7(*h*), 7(*i*), and 7(*j*). The gate lead-out electrodes $GT_2$, $GT_4$, $GT_6$, . . . $GT_n$ are scanned with the latch pulse timing.

At this time, the cathode driver 63 outputs image data for two lines, corresponding to ones obtained by selecting the cathode lead-out electrodes $C_1$, $C_2$, $C_3$, . . . $C_{m+1}$ every other electrode, in synchronism with the scanning operation of the gate lead-out electrodes $GT_2$, $GT_4$, $GT_6$, . . . $GT_n$.

For example, when the gate lead-out electrode $GT_n$ is driven, image data as shown in FIG. 7(*k*p) is not supplied to the cathode lead-out electrode $C_1$. But, image data corresponding to the $R_{(n-1)2}$ dot associated with the n(n−1)-th line as shown in FIG. 7(*l*) is output to the cathode lead-out electrodes $C_2$; the $Rn_2$ dot associated with the n-th line as shown in FIG. 7(*m*) is output to the cathode lead-out electrodes $C_3$; and the $G_{(n-1)4}$ dot associated with the (n-1)-th line as shown in FIG. 7(*n*) is output to the cathode lead-out electrode $C_4$.

Hence, when the gate lead-out electrode $GT_2$ is selectively driven with the latch pulse timing as shown in FIG. 9(*a*), the shift register 61 shifts the even-numbered image data associated with the first and the second lines by means of the shift clock S-CLK. In the image display 50, the even-numbered dots associated with the first and the second lines are controllably glowed.

When the gate lead-out electrode $GT_4$ is selectively driven with the next latch pulse timing, the shift register 61 shifts the even-numbered image data associated with the third and the fourth lines by means of the shift clock S-CLK. In the image display 50, ½ of dots associated with the third line and ½ of dots associated with the fourth line are controllably glowed.

When the gate lead-out electrode $GT_n$ is selectively driven with the last latch pulse timing in one frame, the shift register 61 shifts the even-numbered image data associated with the (n-1)-th line and the n-th by means of the shift clock S-CLK. In the image display 50, the (n−1)-th dot and the n-th dot are controllably glowed as shown in FIG. 8(*e*).

In such a scanning operation, the remaining dots in one frame can be controllably glowed. When the gate lead-out electrode GTn associated with the last line is scanned, the image for one frame is displayed on the image display 50.

According to the driver circuit as described above, the neighbor patchlike gate electrodes 3 around the patchlike electrode 3 selectively driven are set to a low level while the anode electrodes 8 or 9 not selectively driven are set to a low level. Thus, since the emitted electrons are more focused, a blur-free color, high resolution field emission image display can be provided.

Conventionally, the gate lead-out electrode arrangement which is formed of 2n gate lead-out electrodes twice the number of the display lines are selectively driven to display the full color image display. In contrast, according to the present invention, since the gate lead-out electrode arrangement, which can be realized with (n+1) gate lead-out electrodes 6 only one larger than the number of display lines (n lines), can be selectively driven, the duty can be doubled, thus realizing high brightness.

Moreover, since the number of times a high voltage is selectively applied to the anode lead-out electrode A1 or A2 is only twice for one frame, the driver circuit for the anode lead-out electrodes can be easily fabricated.

Since the number of the gate lead-out electrodes 6 can be reduced, the terminal pitch of the gate lead-out electrodes 6 can be expanded.

Moreover, since the anode electrodes 8 and 9 in a stripe form can ease the fabrication process patterning an ITO (Indium Tin Oxide) thin film.

According to the method of driving the filed emission display, since the gate driver 63 drives the capacitive load, the totem-pole type driver may be preferably used for high-rate drive operation, rather than the open collector-type driver.

Figure 10:
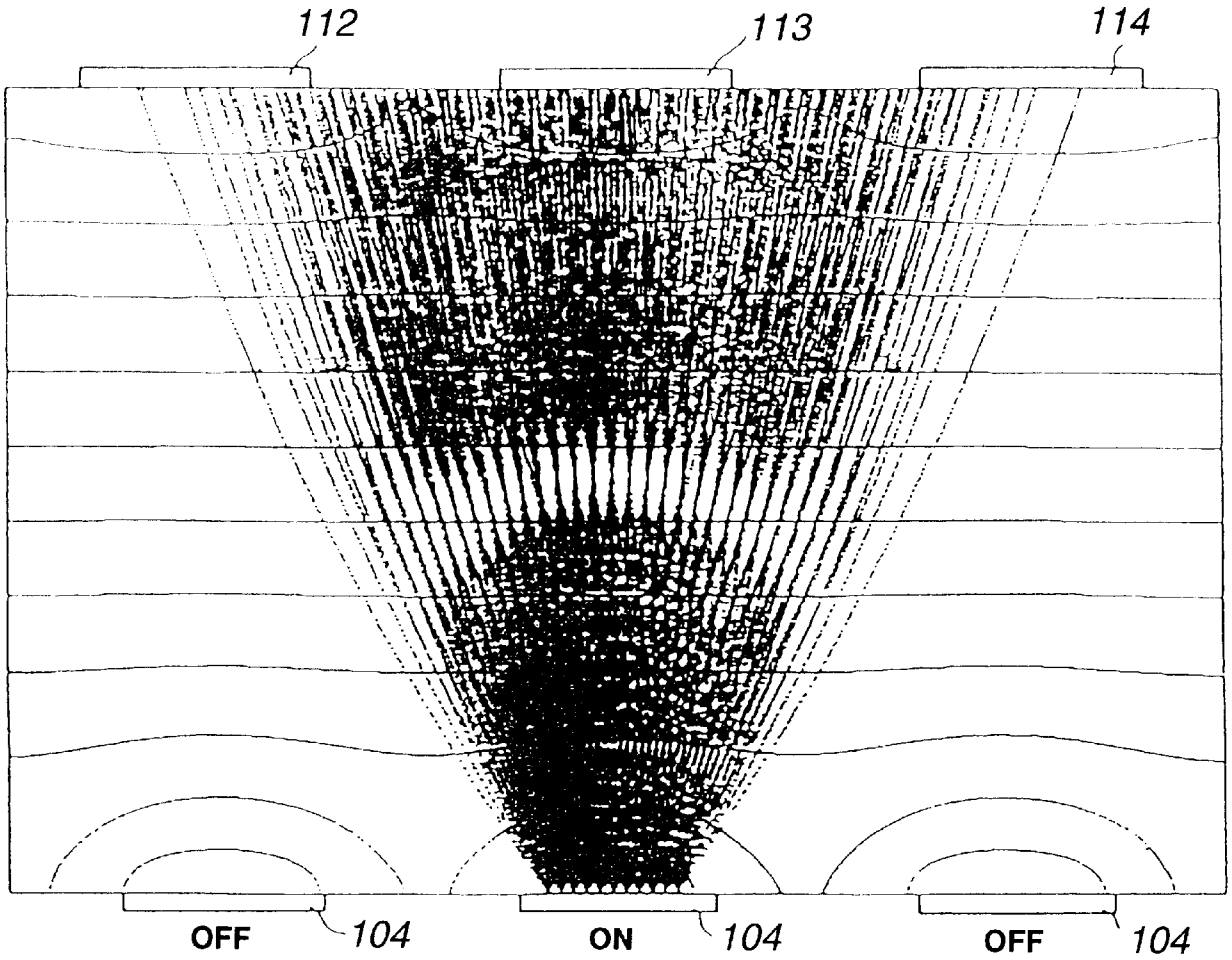
FIG. 10 is a distribution diagram illustrating the locus of electrons emitted from a conventional field emission cathode.
Figure 11:
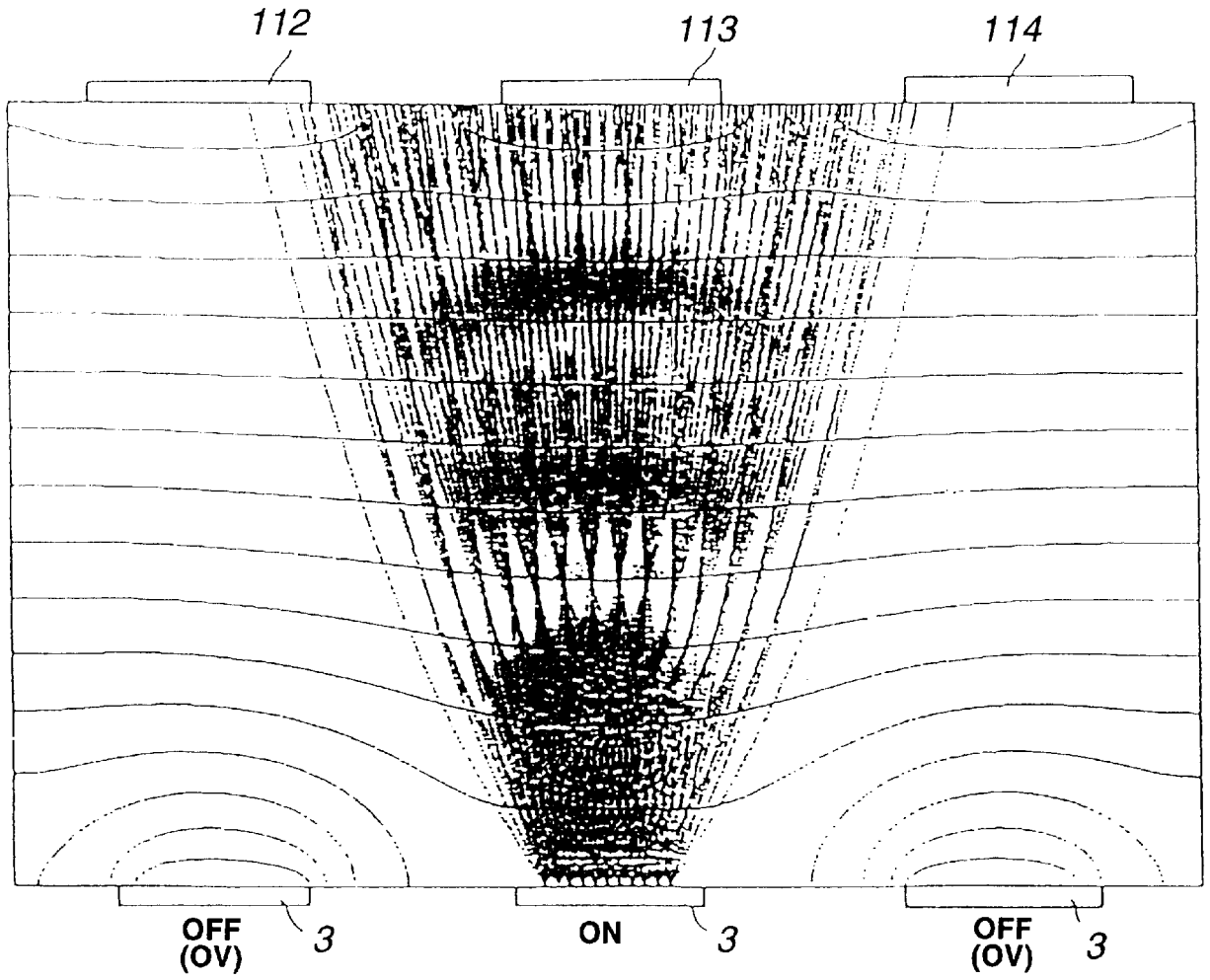
FIG. 11 is a distribution diagram illustrating the locus of electrons emitted from a field emission cathode.
Figure 12:
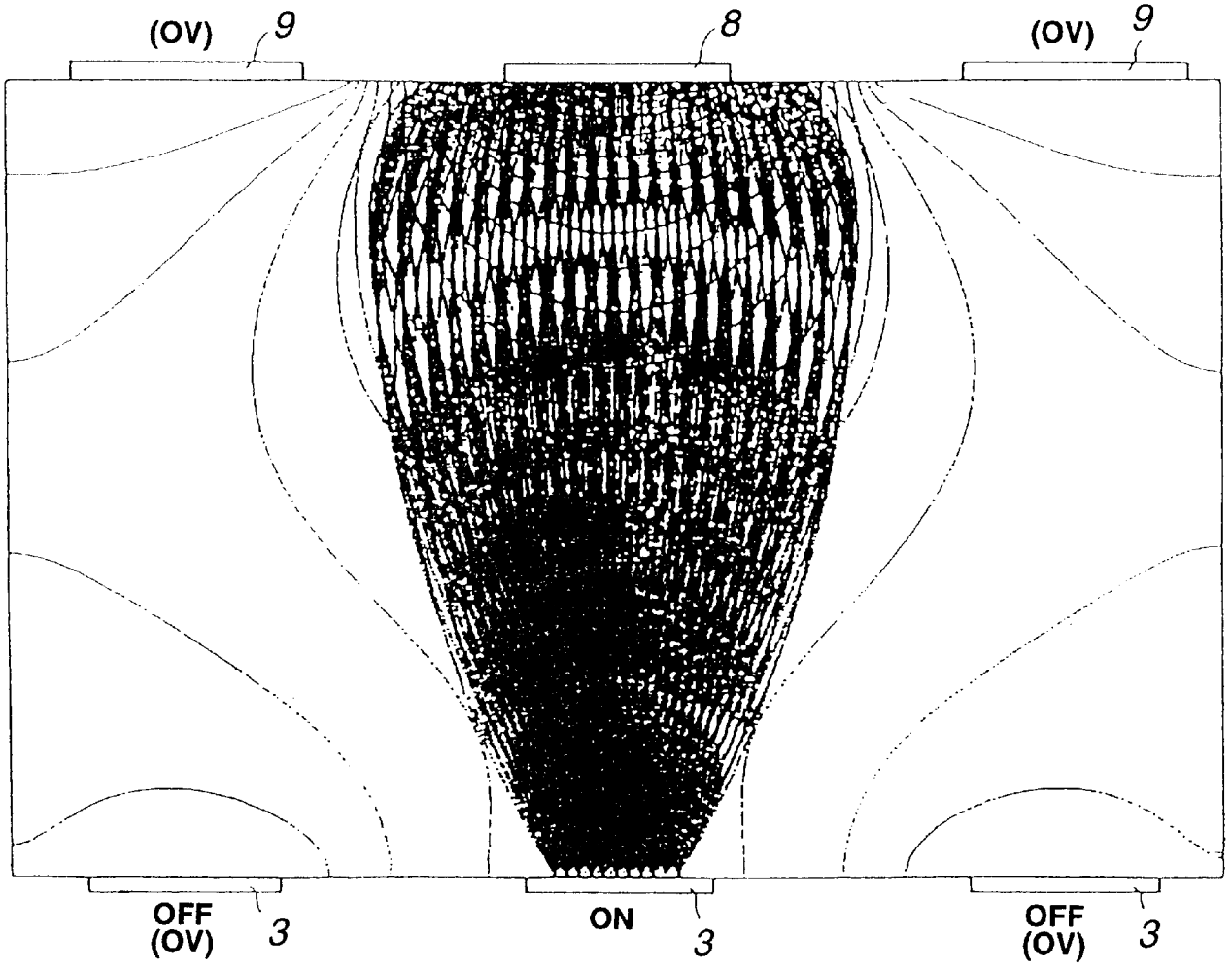
FIG. 12 is a distribution diagram illustrating the locus of electrons emitted from a field emission cathode of the present invention.
Figure 13A:
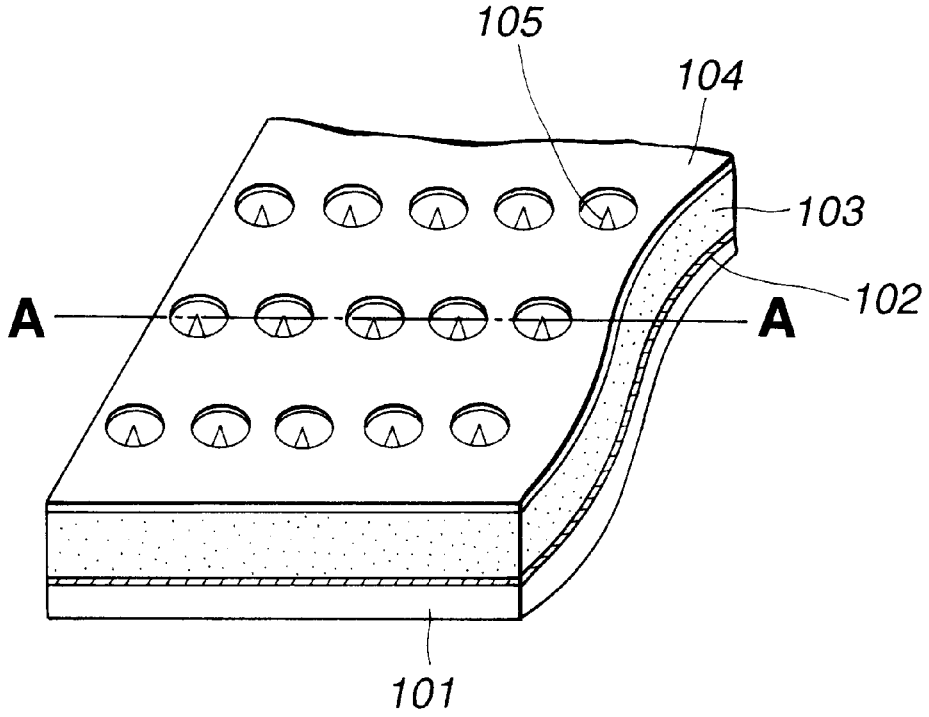
FIG.13(a) (PRIOR ART)
FIG. 13 is a diagram illustrating the configuration of a conventional field emission cathode.
Figure 13B:
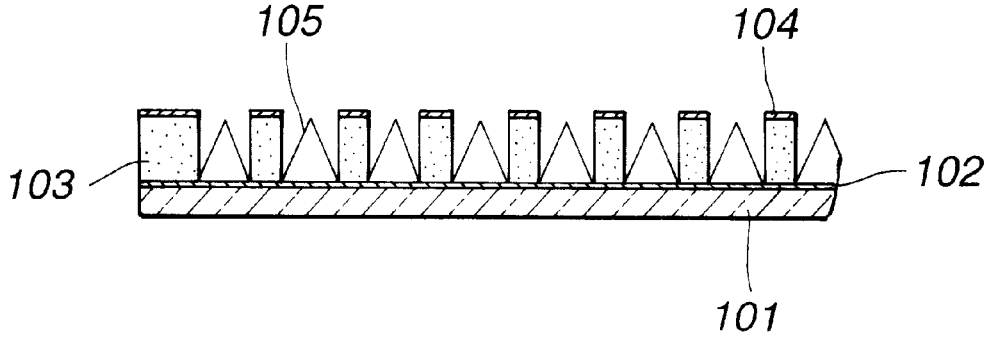
FIG.13(b) (PRIOR ART)

Next, the effect of focusing electrons emitted from an emitter in the field emission image display of the present invention will be described by referring FIGS. 10 to 12. FIGS. 10 to 12 illustrate simulation results of locus distributions of emitted electrons reaching an anode electrode.

Figure 14:
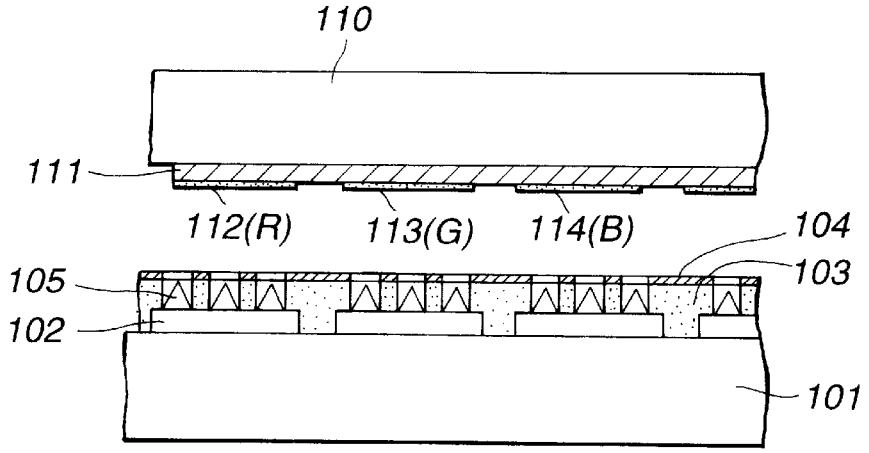
FIG.14 (PRIOR ART)
FIG. 14 is a cross-sectional view illustrating a conventional field emission image display.

FIG. 10 shows a locus distribution simulation in a conventional field emission cathode. The anode electrodes 112, 113 and 114 are set to the same potential. The gate electrode 103 is formed in a stripe pattern. All the gate electrodes for one line are set to the same potential. This corresponds to the prior art structure shown in FIG. 14.

In this case, the emitter array on the cathode substrate field-emits electrons with an angle of about 30. The electrons reach to the anode electrode with a diameter relatively spread. For example, the electrons which pass through the gate electrode 104 with a drive voltage applied (on) partially reach the anode electrode 112 adjacent to the anode electrode 113, thus causing leakage of glowed light.

Figure 15:
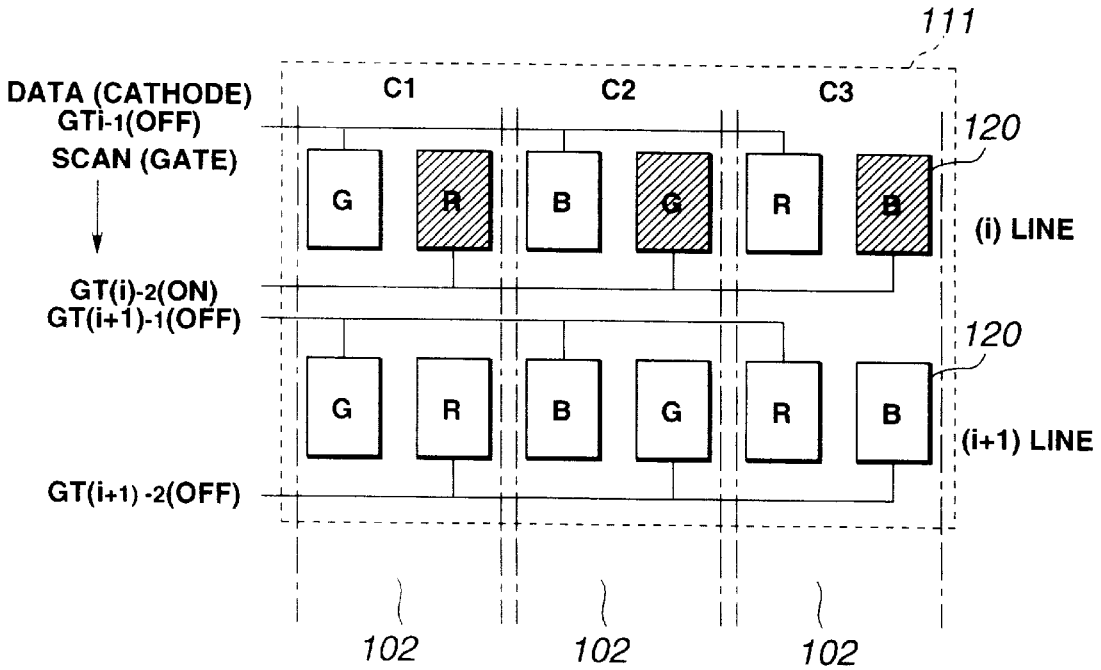
FIG. 15 is a top view illustrating a field emission image display previously proposed by the present applicant.

FIG. 11 illustrates a simulation result of a locus distribution of emitted electrons. Referring to FIG. 11, the neighbor patchlike gate electrodes 3 around the patchlike gate electrode 3 to which a drive voltage is applied (on) are set to the ground level (or an off level). The anode electrodes 112, 113 and 114 are set to the same potential. The structure in FIG. 15 corresponds to a prior art structure. In this case, the spread of the electrons field emitted via the patchlike electrode 3 to which a drive voltage is applied is narrower than that shown in FIG. 10.

FIG. 12 illustrates a simulation result of a locus distribution of emitted electrons. Referring to FIG. 12, the neighbor patchlike gate electrodes 3 around the patchlike gate electrode 3 to which a drive voltage is applied (on) are set to the ground level (or an off level). The stripe anode electrodes 8 and 9 are formed in a stripe pattern. The neighbor anode electrode 9 on the right and left sides the anode electrode 8 to which a drive voltage is applied (turned on) is set to the same potential.

In this case, the spread of the electrons field-emitted via the patchlike electrode 3 to which a drive voltage is applied is narrower than that shown in FIG. 11, so that the reduced electrode beam directs to a target patchlike anode electrode 8.

As described above, the field emission image display of the present invention can prevent a leakage of glowed light. Hence a high resolution field emission image display can be configured that can glow only the fluorescent substance layer coated on a target patchlike anode electrode.

The example where the filed emission image display employs three primary color fluorescent substances for red, blue and blue light emission has been showed in the above embodiments. However, plural luminous colors may be displayed by passing the light emitted from a fluorescent substance with a wide luminous wavelength range through a filter with transparent wavelength characteristics. Moreover, a color image may be displayed using two fluorescent substances. The filed emission image display may be a monochrome display.

The fluorescent substance may be coated on the anode electrode or a fluorescent substance thin film may be deposited on the anode electrode.

As described above, in the field emission image display of the present invention, the neighbor patchlike gate electrode on the right and left sides of patchlike gate electrodes driven are set to a low potential. The anode electrode region immediately above the driven patchlike gate electrodes also is simultaneously driven. A low potential is set to the neighbor anode electrodes on the right and left sides of the driven anode electrode. Thus, since electrons emitted from the emitter can be better focused, a high resolution field emission image display can be configured to provide blurred images.

In the field emission image display of the present invention, the cathode lead-out electrode is formed to connect metal patchlike cathode electrodes in a zigzag pattern. Hence, the anode electrode formed of an ITO thin film, which is resistant to micro-patterning compared with the metal material, is formed in a patchlike pattern. The pattern formation can be easily performed by forming the anode lead-out electrodes so as to make connections to the patchlike anode electrodes in a zigzag pattern.

It is sufficient that the number of gate lead-out electrodes is only one more than that of the display lines in the image display. Hence, compared with the case where the gate lead-out electrodes in number twice the number of the display lines are selectively driven, the duty can be substantially doubled, so that high brightness can be realized.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A field emission image display comprising:

a first substrate;

plural patchlike cathode electrodes arranged in a matrix form on said first substrate, each of said patchlike cathode electrodes including emitters for field emission;

cathode lead-out electrodes each being connected in a zigzag pattern to two neighbor rows of patchlike cathode electrodes in a two-dimensional matrix formed of said patchlike cathode electrodes;

plural patchlike gate electrodes formed over said patchlike cathode electrodes;

gate lead-out electrodes connected to plural patchlike gate electrode pairs arranged in the row direction every other row, said plural patchlike gate electrode pairs being associated with two neighbor lines in a two-dimensional matrix formed of said patchlike gate electrodes;

a second substrate confronting said first substrate so as to be spaced from each other apart a predetermined distance;

plural stripe anode electrodes arranged on said second substrate so as to confront said patchlike gate electrodes;

fluorescent substance layers respectively coated on said anode electrodes;

first anode lead-out electrodes connected to odd-numbered ones of said anode electrodes; and second anode lead-out electrodes for connected to even-numbered ones of said anode electrodes.

* * * * *